US008057264B2

(12) United States Patent
Lam

(10) Patent No.: US 8,057,264 B2
(45) Date of Patent: Nov. 15, 2011

(54) MULTI-PURPOSE POWER PLUG WITH IMPROVED LOCKING DEVICE

(75) Inventor: Hok Man Lam, Hong Kong (CN)

(73) Assignee: Shun Shing Standard Corporation Development Ltd., NT (HK)

( * ) Notice: Subject to any disclaimer, the term of this patent is extended or adjusted under 35 U.S.C. 154(b) by 0 days.

(21) Appl. No.: 12/525,559

(22) PCT Filed: Jan. 30, 2008

(86) PCT No.: PCT/CN2008/000223

§ 371 (c)(1),
(2), (4) Date: Aug. 3, 2009

(87) PCT Pub. No.: WO2008/101385

PCT Pub. Date: Aug. 28, 2008

(65) Prior Publication Data

US 2010/0048063 A1 Feb. 25, 2010

(30) Foreign Application Priority Data

Jan. 31, 2007 (CN) ..... 2007 2 0002230 U

(51) Int. Cl.

| | |
|---|---|
| ***H01R 25/00*** | (2006.01) |
| ***H01R 27/02*** | (2006.01) |
| ***H01R 31/00*** | (2006.01) |
| ***H01R 33/00*** | (2006.01) |

(52) U.S. Cl. ..... 439/640; 439/131; 439/170

(58) Field of Classification Search ..... 439/640, 439/131, 170, 171, 172, 173, 143, 138, 147, 439/136

See application file for complete search history.

(56) References Cited

U.S. PATENT DOCUMENTS

| | | | | |
|---|---|---|---|---|
| 4,993,962 | A * | 2/1991 | Noda et al. | 439/136 |
| 5,050,211 | A * | 9/1991 | Dortu et al. | 379/438 |
| 5,224,868 | A * | 7/1993 | Tseng | 439/136 |
| 5,603,623 | A * | 2/1997 | Nishikawa et al. | 439/144 |
| 5,613,863 | A * | 3/1997 | Klaus et al. | 439/131 |
| 5,634,806 | A * | 6/1997 | Hahn | 439/173 |
| 5,684,689 | A * | 11/1997 | Hahn | 363/146 |
| 6,109,977 | A * | 8/2000 | Baxter et al. | 439/693 |
| 6,261,109 | B1 | 7/2001 | Liu et al. | |
| 6,669,495 | B2 * | 12/2003 | Philips et al. | 439/170 |
| 6,913,473 | B2 * | 7/2005 | Schmid et al. | 439/136 |
| 7,104,830 | B1 * | 9/2006 | Diaz | 439/372 |
| 7,223,126 | B2 | 5/2007 | Ng | |
| 7,637,769 | B2 * | 12/2009 | Carreras Garcia et al. | 439/392 |

FOREIGN PATENT DOCUMENTS

| | | |
|---|---|---|
| CN | 2526998 | 12/2002 |
| CN | 1585207 | 2/2005 |
| CN | 201000984 | 1/2008 |

* cited by examiner

*Primary Examiner* — Hae Moon Hyeon

(57) ABSTRACT

This Utility Model is a multi-purpose plug. It includes a pedestal (1) which is used to connect with the electric equipment. Its feature is that it also includes a number of different-typed plug connectors (2) which are detachably connected with the described pedestal (1). This multi-purpose plug includes a number of different types of plug connectors. They are suitable for various sockets thus making them more convenient to use.

4 Claims, 4 Drawing Sheets

MULTI-PURPOSE POWER PLUG WITH IMPROVED LOCKING DEVICE

CROSS-REFERENCES TO RELATED APPLICATIONS

This application is a U.S. National Phase Entry Application of PCT/CN08/00223 which claims priority of Chinese Patent Application No. 200720002230.7 filed on Jan. 31, 2007.

FIELD OF THE PATENT APPLICATION

The patent application relates to a power plug connector, specifically, is a multi-purpose plug.

BACKGROUND OF THE PATENT APPLICATION

Each country has a different standard for its electrical plugs, thus there are different standard for its sockets that match the plugs. Generally, when a customer buys a electrical plug, it usually adapts to one country only. This may cause a lot of inconvenience. For example, for those international businessmen who often need to work in different countries, if the plugs of the laptops they are carrying may adapt to one country only, their work will be dramatically impacted.

SUMMARY OF THE PATENT APPLICATION

This patent application is addressing the disadvantage of the current technology and provides a kind of Multi-purpose plug.

The solution adopted by this patent application in addressing the technical issue is: making a kind of multi-purpose plug, including a pedestal which is used to connect with the electric equipment, its feature is that it also includes a number of different-types of plug connectors which are detachably connected with the described pedestal.

In the described multi-purpose plug of this patent application, the described pedestal has a slot. On the end of the described plug connector, there is an inserted handle which matches the described slot. It also includes a locking device which fixes the described inserted handle into the described slot.

In the described multi-purpose plug of this patent application, the described locking device includes a box-shaped structure. Inside the described box-shaped structure, there is a bolt tab. A press plug locates on the external part of the described box-shaped structure which corresponds to the described bolt tab. The described press plug is inserted into the described slot and is connected with the described pedestal via a spring. The box-shaped structure of the described press plug is parallel to the plane in which the mouth of the inserted slot sits.

In the described multi-purpose plug of this patent application, the described inserted handle has a mounting hole which corresponds to the described bolt tab.

In the described multi-purpose plug of this patent application patent application, the described pedestal has an electrical connection device for the pedestal. The described inserted handle has an electrical connection device for the inserted handle which matches the electrical connection device for the described pedestal.

In the described multi-purpose plug of this patent application, the described pedestal has a power outlet and a power supply unit.

Implementation of the multi-purpose plug in this patent application has following benefits: the multi-purpose plug in this patent application includes a number of different-types of plug connectors. They are suitable for various sockets thus are more convenient to use.

The patent application is further illustrated by using the attached figures and a practical example. Among the attached figures.

DETAILED DESCRIPTION

This patent application involves a kind of multi-purpose plug. The multi-purpose plug includes a number of different-types of pedestals 1 which are used to connect with the electrical equipment and a number of different-typed plug connectors 2 which are detachably connected with pedestals 1.

Figure 1:
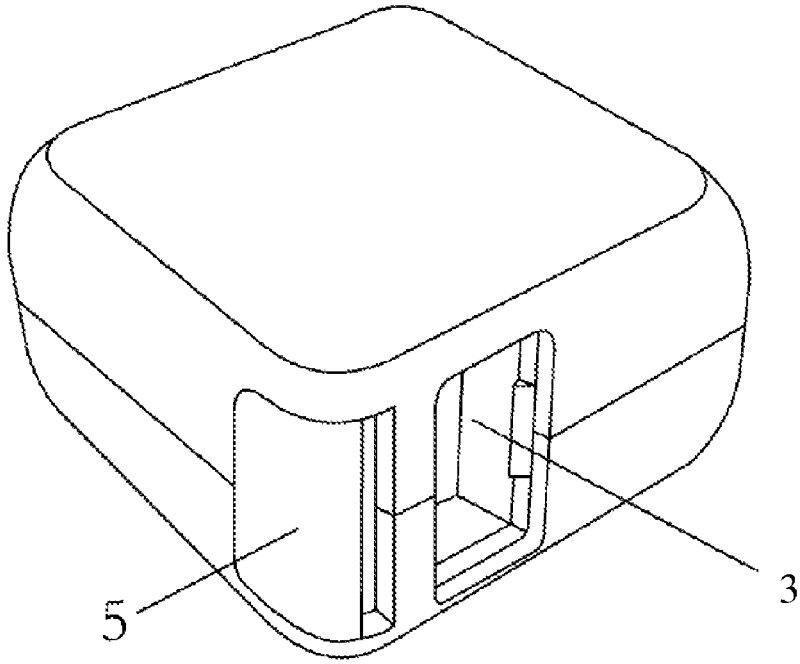
FIG. 1 is the structural sketch of the multi-purpose plug in this patent application.
Figure 2:
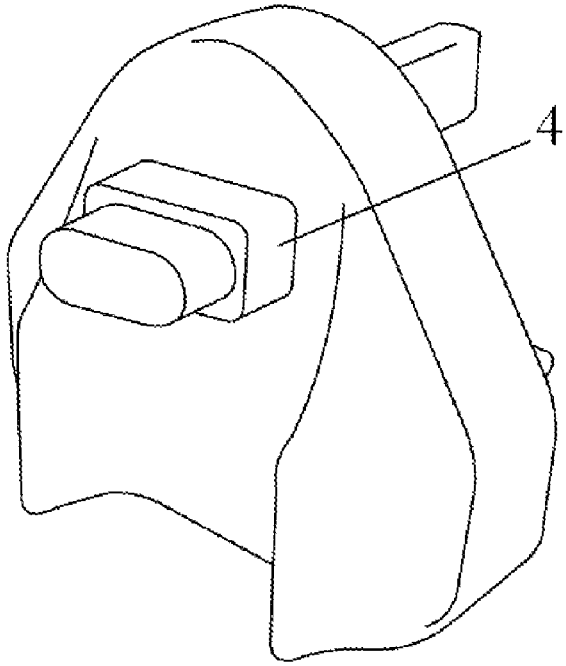
Figure 2 (Prior Art)
FIG. 2 is the structural sketch of the plug connector in the first implementation method of the multi-purpose plug in this patent application.
Figure 3:
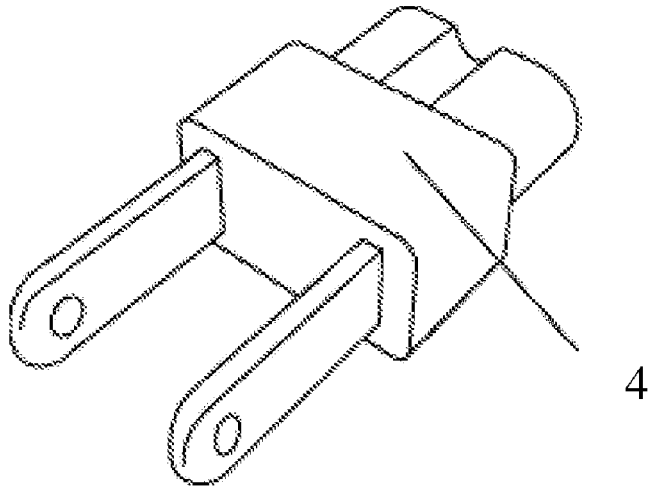
Figure 3 (Prior Art)
FIG. 3 is the structural sketch of the plug connector in the second implementation method of the multi-purpose plug in this patent application.
Figure 4:
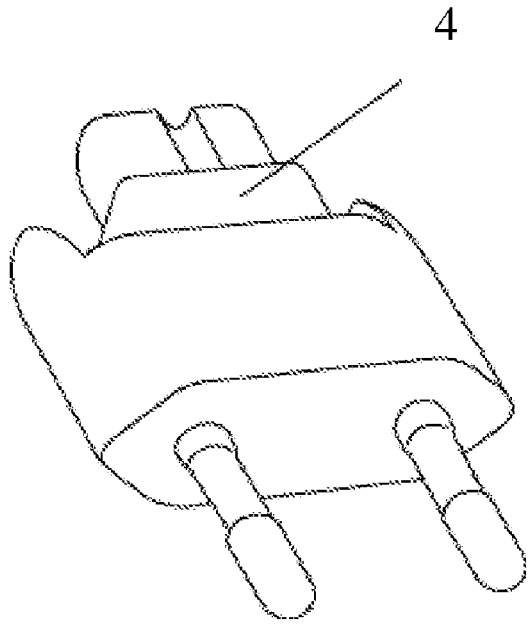
Figure 4 (Prior Art)
FIG. 4 is the structural sketch of the plug connector in the third implementation method of the multi-purpose plug in this patent application.

FIG. 1 is the structural sketch of the pedestal of the multi-purpose in this patent application. FIG. 2 is the structural sketch of the plug connector in the first implementation method. This plug connector is commonly seen in United Kingdom (UK). FIG. 3 is the structural sketch of the plug connector in the second implementation method. This plug connector is commonly used in North America and Japan. FIG. 4 is the structural sketch of the plug connector in the third implementation method. This plug connector is commonly used in Korea. The Multi-purpose plug in this patent application can be used in different countries.

Figure 5:
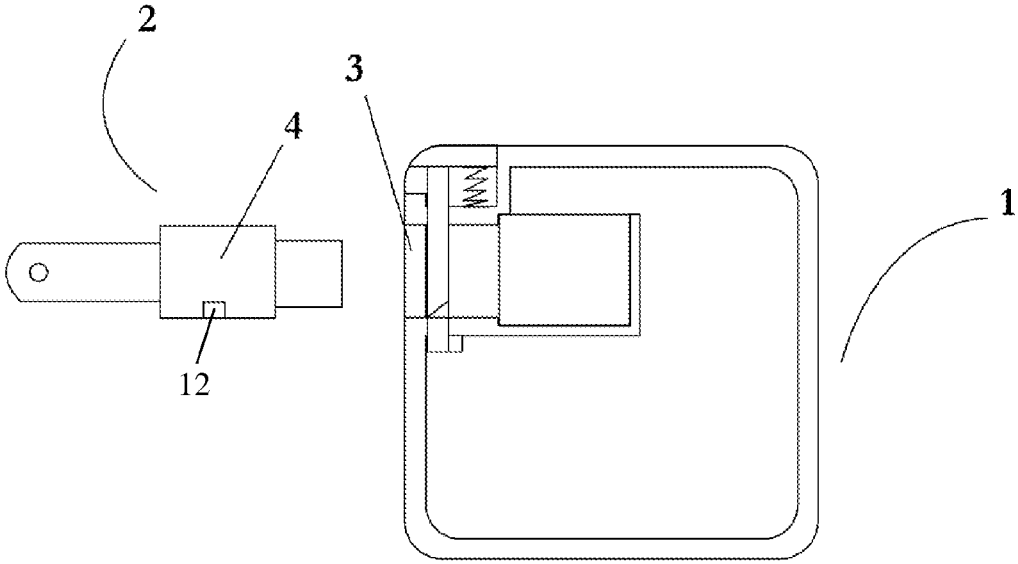
FIG. 5 to FIG. 7 is the structural sketches showing the process of the inserted plug of the plug connector of the multi-purpose plug in this patent application being inserted into the pedestal.
Figure 6:
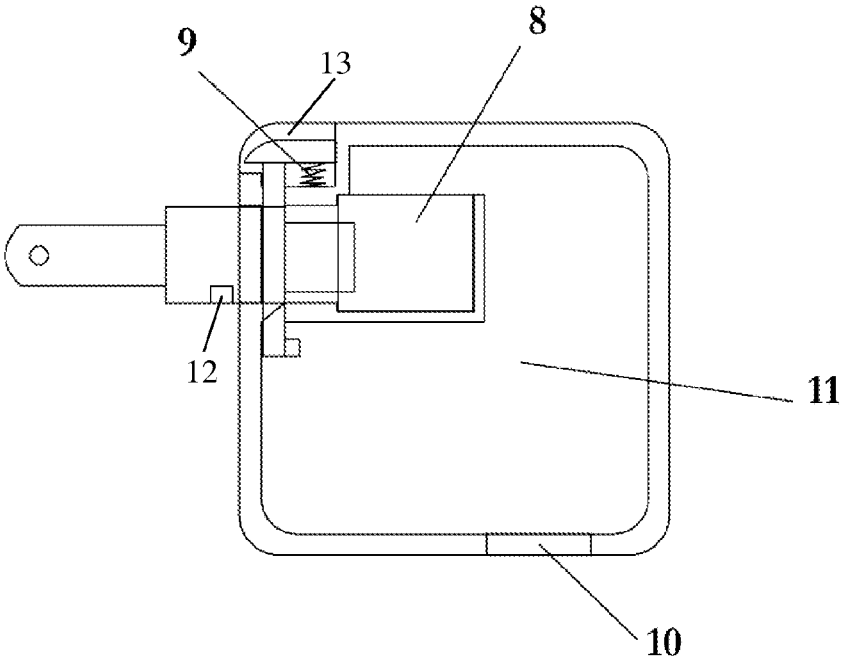
Figure 7:
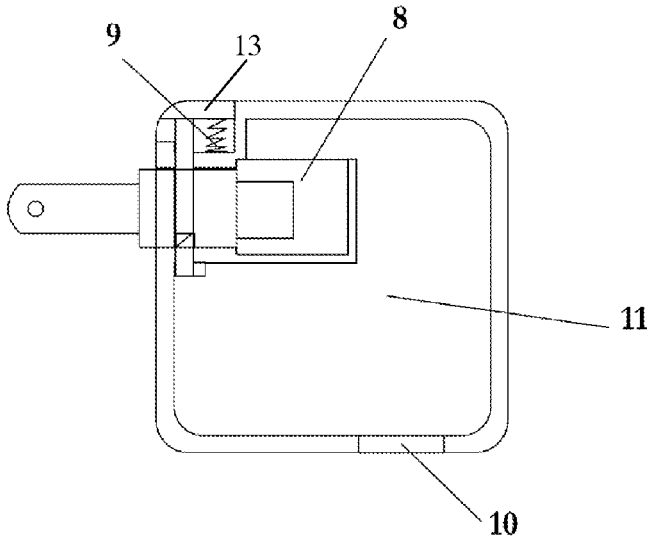
Figure 8:
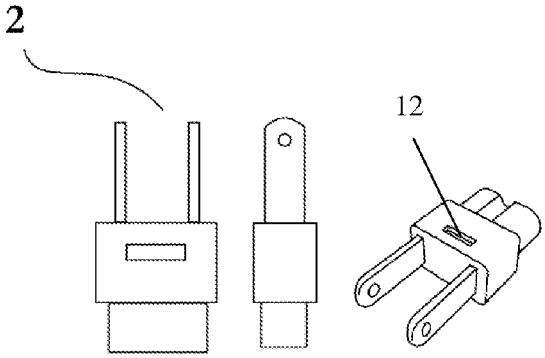
FIG. 8 is the sectional view of the plug connector of the multi-purpose plug in this patent application.
Figure 9:
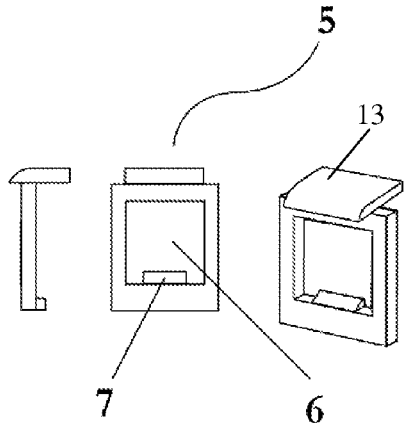
FIG. 9 is the sectional view of the locking device of the multi-purpose plug in this patent application.

FIG. 8 is the sectional view of the plug connector of the multi-purpose plug in this patent application. FIG. 9 is the sectional view of the locking device of the multi-purpose plug. The combined FIG. 8 and FIG. 9 describe the way of connection between the plug connector and the pedestal in this patent application. In them, the described pedestal 1 has a slot 3. There is an inserted handle 4 at the end of the plug connector 2 which corresponds to the described slot 3. The inserted handle 4 has a mounting hole 12 which corresponds with the described bolt tab 7. Pedestal 1 has an electrical connection device 8 for the pedestal. The described inserted handle 4 has an electrical connection device for the inserted handle which matches the electrical connection device 8 for the described pedestal. The described pedestal 1 has a power outlet 10 and a power supply unit 11. A locking device 5 is also included which fixes the described inserted handle 4 into the described slot 3. FIG. 9 is the structural sketch of the locking device 5. This Locking device 5 includes a box-shaped structure 6. Inside the described box-shaped structure 6, there is a bolt tab 7. The external part of the described box-shaped structure which corresponds to the described bolt tab 7 has a press plug 13. The described press plug 13 is inserted into the described slot 3 and is connected to the described pedestal 1 via spring 9. The box-shaped structure 6 is parallel to the plane in which a mouth of the described slot 3 sits FIG. 5 to FIG. 7 are the structural sketches showing the process of the plug connector of the multi-purpose plug in this patent application being inserted into the pedestal. The combined figures describe the way the plug connector is fixed into the pedestal. While the plug connector 2 is inserted into the slot 3 of the pedestal 1, the bolt tab 7 is pressed down thus the entire locking device 5 is pressed down. After fully inserted, the locking device 5 will restore to its original position under the elasticity of the spring 9. The bolt tab 7 will be locked in the mounting hole 12 of the bolt tab 7 and tightly lock the plug connector 2.

While pulling out, first press the press plug down, making the bolt tab 7 retreat from the mounting hole 12, then pulling the plug connector 2 out.

The invention claimed is:

1. A multi-purpose plug, comprising a pedestal (1) which is used to connect with an electric equipment, and a number of different-types of plug connectors (2) which are detachably connected with the pedestal (1), wherein said pedestal (1) has a slot (3), and an inserted handle (4) on an end of the plug connector (2) which matches the slot (3);

said multi-purpose plug also includes a locking device (5) which fixes the inserted handle (4) into the slot (3), said locking device (5) includes a box-shaped structure (6), and a bolt tab (7) disposed inside said box-shaped structure (6), a press plug (13) locates on the external part of the box-shaped structure (6) which corresponds to said bolt tab (7), said press plug (13) is inserted into the slot (3) and is connected with the pedestal (1) via a spring (9), the box-shaped structure (6) is parallel to a plane in which a mouth of the slot (3) sits.

2. The multi-purpose plug according to claim 1, wherein the inserted handle (4) has a mounting hole (12) which corresponds to the bolt tab (7).

3. The multi-purpose plug according to claim 1, wherein the pedestal (1) has an electrical connection device (8) for the pedestal, and the inserted handle (4) has an electrical connection handle for the inserted handle which matches the electrical connection device (8) for the pedestal.

4. The multi-purpose plug according to claim 1, wherein the pedestal (1) has a power outlet (10) and a power supply unit (11).

* * * * *